United States Patent [19]

McCourt

[11] Patent Number: 4,583,252

[45] Date of Patent: Apr. 22, 1986

[54] SPONGE BATH AND RINSE PLATFORM

[76] Inventor: William A. McCourt, 3936 Ireland St., Sacramento, Calif. 95821

[21] Appl. No.: 705,814

[22] Filed: Feb. 26, 1985

Related U.S. Application Data

[63] Continuation-in-part of Ser. No. 618,209, Jun. 7, 1984, abandoned.

[51] Int. Cl.[4] ..... A47K 3/02

[52] U.S. Cl. ..... 4/584; 4/538; 4/546; 4/554; 5/110; 5/111; 5/82 R

[58] Field of Search ..... 4/585, 584, 538, 547, 4/559, 554, 661; 5/82, 82 R, 111, 468, 110

[56] References Cited

U.S. PATENT DOCUMENTS

| | | | |
|---|---|---|---|
| 3,021,531 | 2/1962 | Hinge | 4/585 |
| 3,066,320 | 12/1962 | Russell | 5/82 |
| 3,246,346 | 4/1966 | Schmidt | 4/585 |
| 4,033,000 | 7/1977 | Bonifay | 5/82 R |
| 4,034,424 | 7/1977 | Budlong | 4/585 |
| 4,234,977 | 11/1980 | Snow | 5/110 |
| 4,234,978 | 11/1980 | Snow | 5/111 |
| 4,312,084 | 1/1982 | Browning | 4/538 |
| 4,434,517 | 3/1984 | Dorris | 4/585 |
| 4,485,502 | 12/1984 | Marcanio | 4/585 |

*Primary Examiner*—Henry K. Artis

*Attorney, Agent, or Firm*—Townsend & Townsend

[57] ABSTRACT

A sponge bath and rinse platform on which the user (patient) lies for cleansing. The device is formed with a peripheral wall (defined by side walls, a head end wall, and a foot end wall) and a central area having a number of specially contoured areas for raising selected portions of the body above a gently sloping grade plane. The lowest region of the central area is located near the foot end wall, and defines a liquid collection area. The contoured areas define supports for the head, upper trunk, lower trunk, arms, and legs. Thus, the device includes a head support, an upper trunk support, a lower trunk support, first and second arm supports, and first and second leg supports. These are formed so that when the user's head is on the head support, the arms held outwardly from the body on the arm supports, shoulder blade area on the upper trunk support, the lower back on the lower trunk support, and the legs in a spread apart position on the leg supports, the user's armpit and groin areas are elevated above the grade plane and freely accessible for cleansing.

11 Claims, 11 Drawing Figures

SPONGE BATH AND RINSE PLATFORM

CROSS-REFERENCE TO RELATED APPLICATION

This application is a continuation-in-part of Application Ser. No. 618,209, filed June 7, 1984, now abandoned.

FIELD OF THE INVENTION

The present invention relates generally to health care appliances, and more specifically to a rinse platform that allows bedridden patients to be given proper sponge baths.

BACKGROUND OF THE INVENTION

"Cleanliness of body was ever esteemed to proceed from a due reverence to God."—Francis Bacon "Cleanliness is, indeed, next to Godliness."—John Wesley Personal hygiene has long been valued in our society, and while many might question the connection between hygiene and religion, it can scarcely be denied that personal cleanliness adds immeasurably to one's sense of well-being. Unfortunately, for the bedridden person in a hospital, convalescent home, or home care setting, the sense of well-being afforded by a daily bath or shower is unavailable. Rather, a sponge bath is the normal alternative.

As is well known, the sponge bath procedure entails wiping of the person's body with a wet sponge or cloth, followed by towel drying and possibly the application of lotion or powder. However, since the normal physical setting of the sponge bath is on a bed, no liquid rinse is offered, and the sponged person is left with a feeling of discomfort. Nevertheless, the sponge bath represents a generally meaningful approach to the problem, and does meet at least some minimal requirements of body cleanliness, even though failing to provide the level of cleanliness desired by most people.

The desirability of bathing bedridden patients has been recognized in the prior art. For example, U.S. Pat. No. 4,312,084 to Browning discloses an inflatable bathtub, while U.S. Pat. No. 4,434,517 to Dorris shows a collapsible bathtub. Such devices are relatively complicated and require a variety of assembly or construction steps to erect the bathtub around the patient prior to use. Moreover, the prior art bathtubs for bed use require relatively large volumes of water in order to provide meaningful cleansing.

Much of the prior art relating to the care of the bedridden person has been designed for use in a hospital or other institutional setting. Not surprisingly, the complexity, cost, and difficulty of use of such prior art devices render them unsuitable for use at home. While the need to provide appliances for home care has been recognized, it seems that the home and hospital settings impose incompatible requirements. Devices for the hospital are necessarily very rugged, which typically translates into high cost and difficulty of use. Devices for the home must satisfy more stringent cost and weight constraints, which typically translate into flimsiness and reduced functionality.

SUMMARY OF THE INVENTION

The present invention provides a simple, rugged one-piece device, usable in a bed setting, that allows sponge bath practice to be augmented by proper rinsing. The device requires no special installation technique, fits easily on a single bed, and requires minimal effort on behalf of the person assisting the patient onto and off of the device. The device is readily cleaned, is lightweight, and stores easily. Thus, the invention finds applicability in both hospital and home care settings.

The present invention is a sponge bath and rinse platform on which the user (patient) lies for cleansing. The general configuration is that of a wedge, slightly higher at the head end than the foot end. The device is formed with a peripheral wall (defined by side walls, a head end wall, and a foot end wall) and a central area having a number of specially contoured areas for raising selected portions of the body above a gently sloping grade plane. The lowest region of the central area is located near the foot end wall, and defines a liquid collection area. The contoured areas define supports for the head, upper trunk, lower trunk, arms, and legs. Thus, the device includes a head support, an upper trunk support, a lower trunk support, first and second arm supports, and first and second leg supports. These are formed so that when the user's head is on the head support, the arms held outwardly from the body on the arm supports, shoulder blade area on the upper trunk support, the lower back on the lower trunk support, and the legs in a spread apart position on the leg supports, the user's armpit and groin areas are elevated above the grade plane and freely accessible for cleansing. The regions between the upper and lower trunk supports and the first and second arm supports provide respective first and second drainage paths from the region adjacent the head support to the collection area, while a medial groove in the upper and lower trunk supports provides a third drainage path. A drain is conveniently provided at the collection area whereupon rinse liquid can drain into a suitable container for disposal.

The invention is preferably implemented as a one-piece integral structure of resin material. Thus, the invention is relatively economical to manufacture, simple to use, easily cleaned and disinfected, and easily stored. The contours of the head support and the convex, grooved upper and lower trunk supports provide structural strength in those regions where the body weight is concentrated. Thus, the material can be generally thin so that the device is lightweight and convenient to use. The side walls are elevated only slightly above the grade plane and its associated contours, thereby minimizing the effort required to get the user on and off the device.

The platform is preferably formed with a peripheral lip defined by the walls' being turned upwardly and outwardly. The lip reinforces the walls to prevent bowing and broadens the base to prevent tipping. The lip also provides a comfortable safe gripping surface and serves to catch liquid in the event that some splashes over the walls.

A further understanding of the nature and advantages of the present invention may be realized by reference to the remaining portions of the specification and attached drawings.

DESCRIPTION OF THE PREFERRED EMBODIMENT

Figure 1:
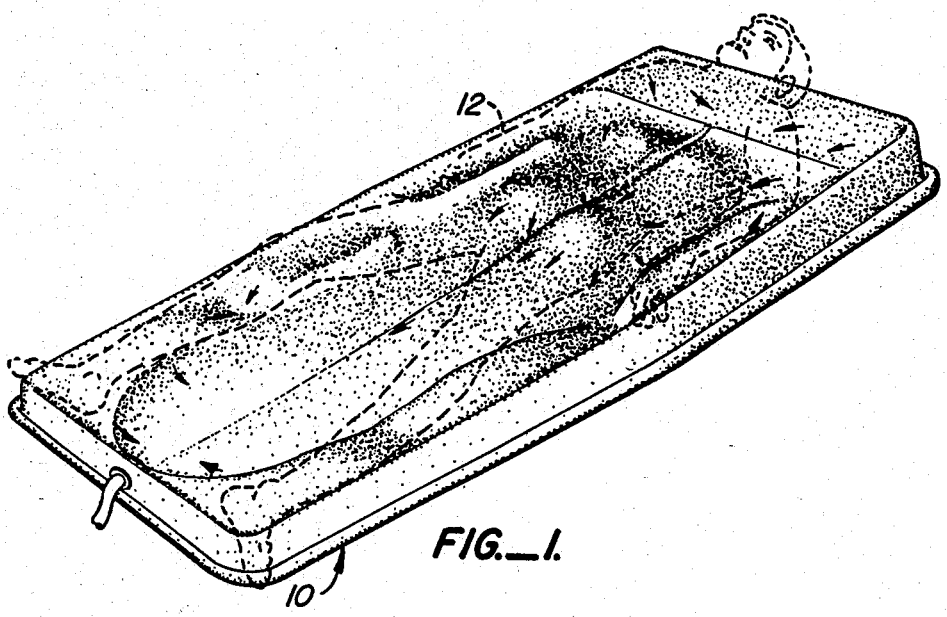
FIG. 1 is a perspective view of a sponge bath and rinse platform according to the present invention.

FIG. 1 is a perspective view showing a sponge bath and rinse platform 10 (hereinafter generally referred to as platform 10) upon which a user 12, shown in phantom, is lying. Typically, user 12 is a patient in a hospital, convalescent home, or other health care facility, although the invention is equally suitable for use in a home care setting. The purpose of platform 10 is to support user 12 in a manner that permits a sponge bath to be augmented by appropriate rinsing.

Figure 3A:
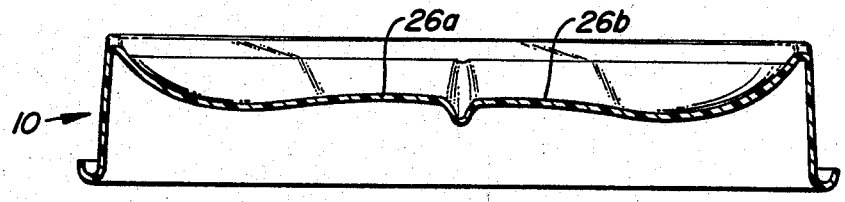
FIGS. 3A, 3B, and 3C are transverse sectional views taken along lines 3A—3A, 3B—3B, and 3C—3C of FIG. 2.
Figure 3B:
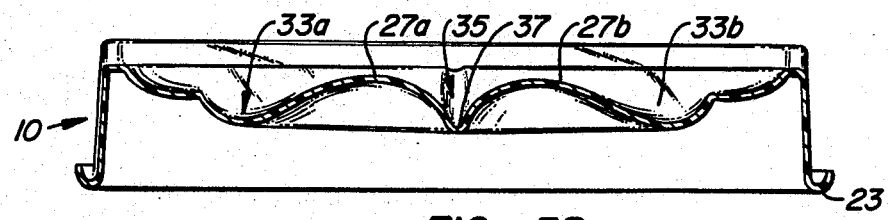
Figure 3C:
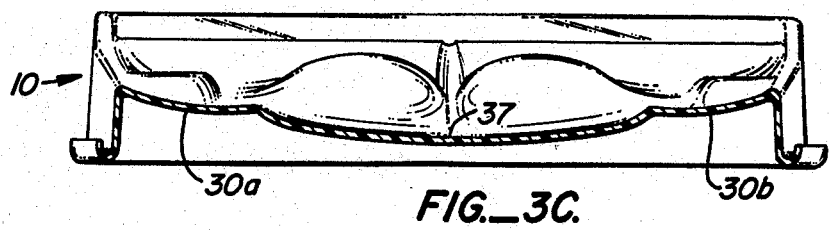
Figure 2:
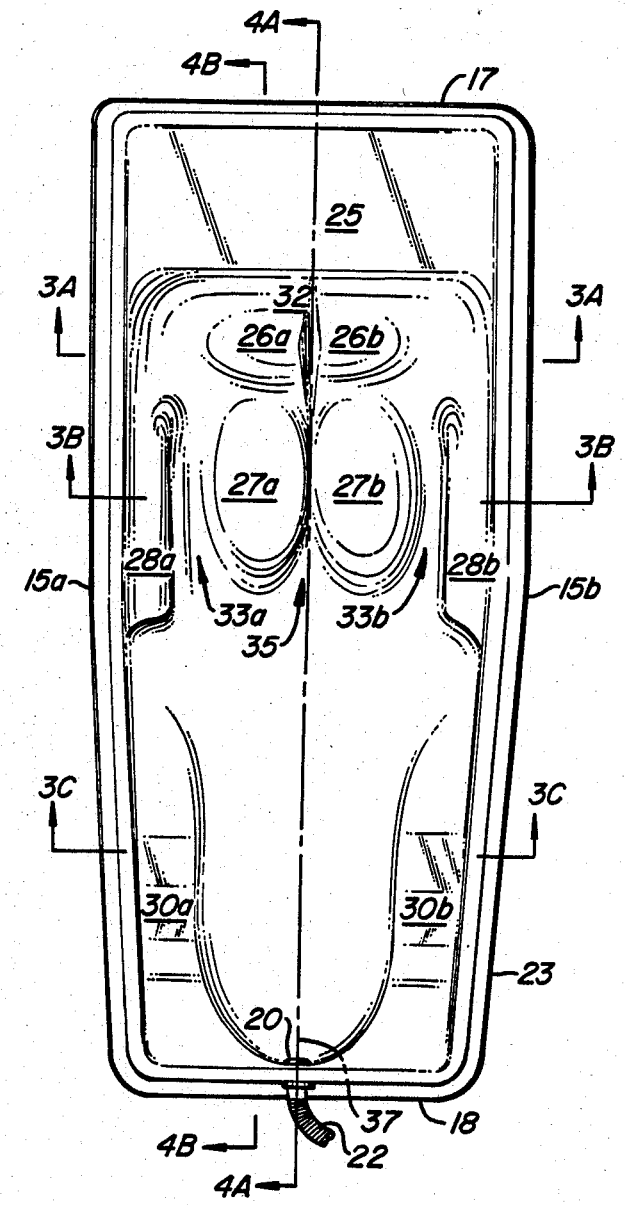
FIG. 2 is a top plan view of the invention.
Figure 4A:
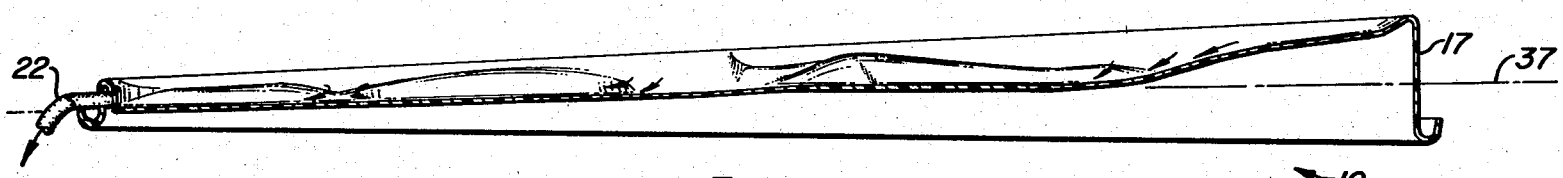
FIGS. 4A and 4B are longitudinal sectional views taken along lines 4A—4A and 4B—4B of FIG. 2.
Figure 4B:
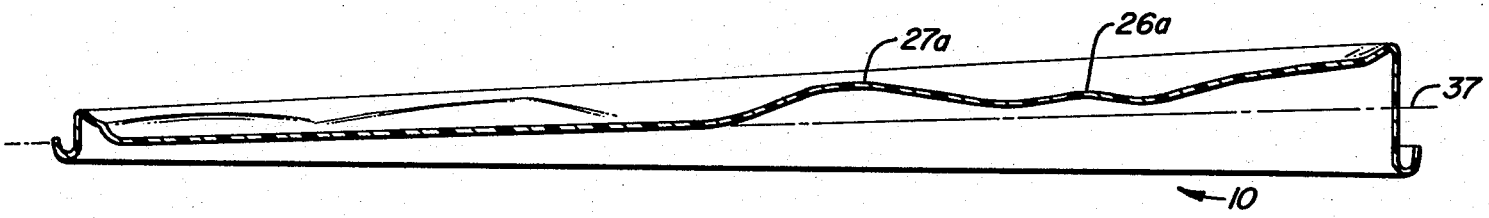

FIG. 2 is a top plan view of platform 10. FIGS. 3A–C are transverse sectional views and FIGS. 4A–B are longitudinal sectional views which, when taken in conjunction with FIG. 2, show the structural details of platform 10. Platform 10 is formed with first and second longitudinal side walls 15*a* and 15*b*, a head end wall 17, and a foot end wall 18, and a liquid-tight contoured bottom within the walls. The contoured bottom supports the user in a manner to be described below.

While the contour is defined by a variety of compound curves and the like, it is conveniently described and easily understood in terms of a gently sloping grade plane and various portions elevated above the grade plane. The overall configuration is such as to provide drainage of liquid from almost any point to a collection area 20, preferably located at the midpoint of foot end wall 18. A conduit 22 is provided, penetrating wall 18 to carry rinse liquid away to a container (not shown) for disposal. Walls 15*a*, 15*b*, 17, and 18 are contiguous on their insides with the contoured bottom. The lower edges of the walls are turned upwardly and outwardly to define a continuous peripheral lip 23.

The contoured bottom defines supports for the user's head, upper trunk, lower trunk, arms, and legs, in particular a head support 25, an upper trunk support 26 having first and second portions 26*a* and 26*b*, a lower trunk support 27 having first and second portions 27*a* and 27*b*, first and second arm supports 28*a* and 28*b*, and first and second leg supports 30*a* and 30*b*.

Head support 25 is in the form of a shelf adjacent head end wall 17 and extending the width of the platform (that is, from side wall 15*a* to side wall 15*b*). The head support slopes downwardly away from the head end wall and is slightly depressed toward the center.

The region between head support 25 and upper trunk support 26 defines a recess 32. The region between lower trunk support portion 27*a* and arm support 28*a* defines a channel 33*a*; that between lower trunk support portion 27*b* and arm support 28*b*, a channel 33*b*. Channels 33*a* and 33*b* provide drainage from recess 32 to collection area 20. Upper trunk support 26 and lower trunk support 27 are formed with a central channel 35 that defines a third drainage path from recess 32 to collection area 20. The bottom of groove 35 is generally coincident with an axis 37 which lies in the grade plane and extends longitudinally to collection area 20.

The physical dimensions of platform 10 are, in effect, defined by the scale of the human body. While a significant amount of dimensional variation may occur without departing from the basic operation described above, a suitable size for use with most adults (heights between about 5 and 6 feet) is a length of about 6 feet and a transverse width of about 2–2½ feet. Head end wall 17 is about 6–8 inches high, foot end wall 18 is about 2–3 inches high, and side walls 15*a* and 15*b* taper accordingly. Differences in user size, body build, and like factors can be taken into account by having the user slide longitudinally as different body parts are washed.

The slope of the grade plane from head to foot need only be so great as to provide good drainage. In general, a 2–6% grade is appropriate, with about 4% being typical. The side walls and end walls are preferably as low as possible in order to facilitate the user's getting on and off the platform, while maintaining a height of about an inch around all areas to prevent liquid from splashing over the top of the walls.

Platform 10 is preferably a one-piece molded article, formed from non-porous material of relatively thin cross-section. ABS and ABS-PVC polymers are appropriate. A polymer material designated R60, sold under the Royalite mark by Uniroyal Plastic Products, Middlebury, Conn., has been found to have low inflammability and high resistance to staining and abrasion, and is therefore a highly suitable material. The thickness is determined at least in part by the proposed environment. A sheet thickness of 3/16 inches results in an 18-pound device that is sufficiently rugged for home and light to medium duty hospital use. A sheet thickness of ⅜ inches results in a 36-pound device that is sufficiently rugged for the most demanding conditions.

The article is thus fairly economical and lightweight. The unitary construction avoids leakage problems while the non-porosity allows for easy cleaning and disinfecting. Fungal growth and other contamination are thus not problems.

The requirements of the molding operation typically impose certain geometric constraints on the geometry of platform 10. For example, the side and end walls taper outwardly toward the bottom to facilitate release from the mold. This has the fortunate effect of making the platform stackable.

Platform 10 is preferably formed with the upper surface free of sharp transitions, thereby eliminating crevices and sharp corners. Such crevices and corners could have the effect of weakening the structure and making cleaning more difficult.

The significance of each of the portions of the contoured bottom is somewhat evident from the nomenclature used. Additional structural details will be described in connection with a description of the use and operation of the invention.

Figure 5:
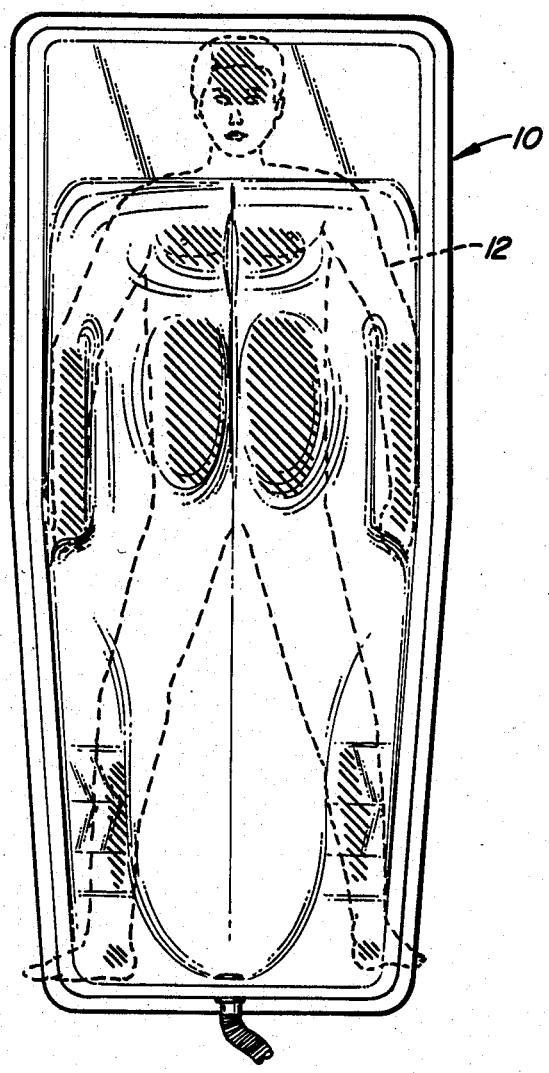
FIG. 5 is a top plan view of the invention showing the areas normally contacted by the user.
Figure 6A:
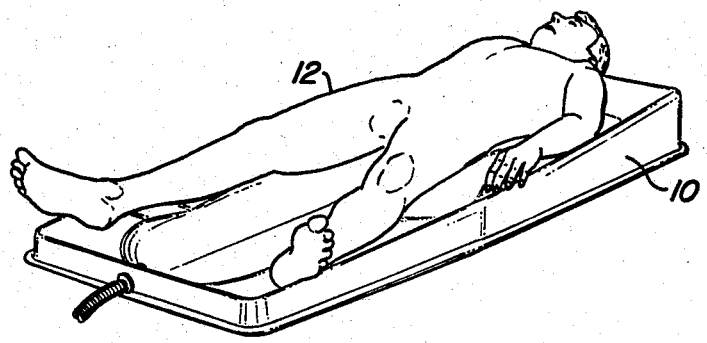
FIGS. 6A–C are perspective views showing the user assuming a variety of postures.
Figure 6B:
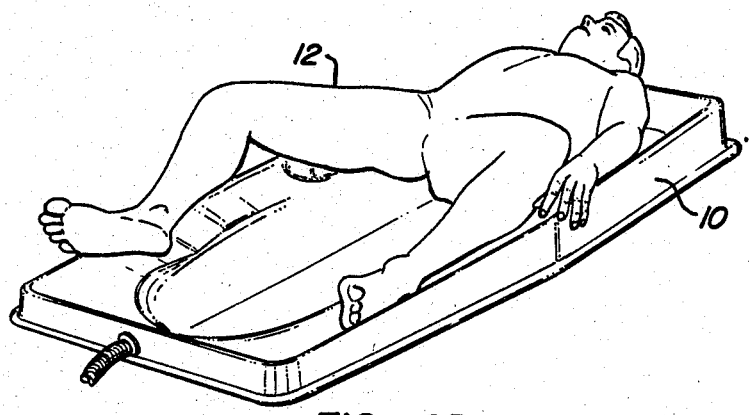
Figure 6C:
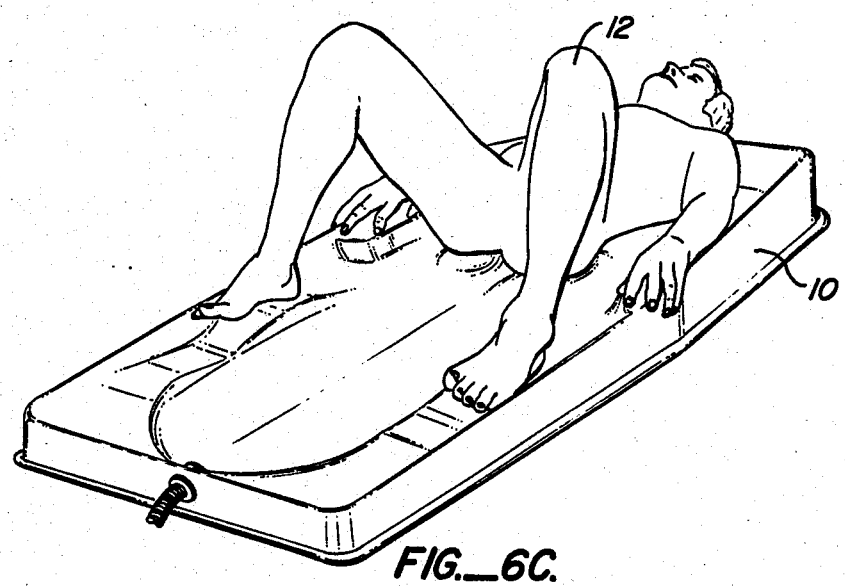

In order to use platform 10, the user gets onto (or is helped onto) the platform. FIG. 5 is a top plan view of platform 10, showing the user's outline in phantom, with crosshatching designating those areas of the user's body that are actually in contact with some portion of the platform. FIGS. 6A–C are perspective views illustrating various postures the user may assume on platform 10. Such variation allows different body portions to be exposed for proper cleaning and rinsing.

When the user's head and upper shoulder area are on head support 25, shoulder blade area on upper trunk support 26, lower back and buttocks on lower trunk support 27, arms on arm supports 28*a–b*, and legs on leg supports 30*a–b*, the user is in a position that allows a surprisingly effective cleaning to occur.

An important feature of the invention is that it supports the user, as much as possible, above the grade plane, out of contact with the contoured bottom, thereby promoting adequate drainage. In particular, the user's neck is disposed above the central depressed area of head support 25 while the armpit areas are generally overlying drainage channels 33*a* and 33*b*. At the same time, lower trunk support 27 maintains the user's groin area elevated above the grade plane. Therefore, the user's neck, armpit, and groin areas may be washed and rinsed thoroughly, with wash and rinse liquid draining down toward collection area 20.

As alluded to above, the present invention provides proper drainage of rinse liquid away from the user's body areas and provides graded flow to collection area 20. Thus, rinse liquid from the neck area runs into recess 32 and then through channels 33*a*, 33*b*, and 35; rinse liquid from the armpit areas runs down channels 33*a–b*; and rinse liquid from the groin area runs down the region between leg supports 30*a–b*. The particular configuration of arm supports 28*a–b* and leg supports 30*a–b* is such as to provide a degree of comfort while also providing drainage paths to prevent any significant liquid accumulation in the event that rinse liquid is poured on the arm supports or leg supports. As can be seen in FIG. 3C, the region between leg supports 30*a* and 30*b*, while generally lying in the grade plane, slopes gently downwardly toward the center, thereby further promoting efficient drainage into collection area 20. With a ¾-inch drain conduit, approximately 1.6 gallons per minute can be drained away from collection area 20. This is more than adequate for the volumes associated with normal rinsing.

Peripheral lip 23 cooperates with other portions of the structure in an advantageous manner. For example, should a small amount of liquid overflow the walls, the liquid will typically fall into the trough defined by peripheral lip 23. Once the user is off the platform, the platform may be tilted and the liquid poured out at a corner. Peripheral lip 23 also provides a convenient gripping surface for the person administering the sponge bath. Should it be necessary to reposition the platform with the user on it, the person can do so without risk of injury from sharp edges. Moreover, peripheral lip 23 broadens the base of the platform, thereby rendering it very stable. This allows the user to roll onto his or her side without having the platform tip upwardly. Even if the user should concentrate all his or her weight along one of the side walls in getting on or off, the likelihood of tipping is very small.

The construction of platform 10 is such as to provide a very rigid structure. For example, peripheral lip 23 and the top portions of the walls define flanges, which reinforce the walls and prevent them from bowing outwardly. Similarly, the convex configuration of lower trunk support 27 provides structural strength in the central area away from the walls where the user's weight tends to be concentrated. Thus, it is possible to make platform 10 out of relatively thin material, thereby decreasing the weight and cost of the device.

In conclusion, it can be seen that the present invention provides a health care appliance that meets the basic hygiene needs of people who are unable for one reason or another to avail themselves of normal bathing facilities. The specially contoured bottom supports the user in the manner in which the parts most in need of good rinsing are maintained in an elevated accessible position while the slope and contours promote efficient drainage.

While the above is a full and complete description of the preferred embodiment of the invention, modifications, alternate constructions, and equivalents may be employed without departing from the spirit of the invention. For example, while a hardshell construction is disclosed, a solid foam construction with a liquid-impervious skin would also be suitable. Moreover, while ABS-type material is disclosed, other materials are likely to be suitable. Fiber-reinforced resins are possible. Graphite, kevlar, polypropylene, acrylic, polyethylene, and polyester fibers may be used; with respect to certain fibers, the provision of a resin matrix is not necessary as the fibers themselves may be softened and bonded by heat. Fiberglass-resin composite would appear to be an attractive material, but care must be taken to prevent the possibility of the glass fibers' becoming exposed on the upper surface. Such could abrade or cut the user as he or she slides onto or off of the platform.

Therefore, the above description and illustrations should not be taken as limiting the scope of the invention which is defined by the appended claims.

What is claimed is:

1. A sponge bath and rinse platform formed as an integral one-piece rigid structure for supporting a user, formed with a generally sloping bottom including raised portions defining:

head support means for supporting the user's head;

lower trunk support means, located to confront the user at about waist level, for supporting the user's lower back and buttocks above said sloping bottom;

arm support means for supporting the user's arms away from the user's trunk; and leg support means for supporting the user's legs in a spread-apart position;

wherein the platform is configured to provide drainage past said arm support means to a collection area;

whereupon when the user's head is on said head support means, the user's arms on said arm support means, the user's lower back and buttocks on said lower trunk support means, and the user's legs on said leg support means, the user is in a position with the user's armpit and groin areas maintained above said sloping bottom and freely accessible for cleansing with said sloping bottom providing adequate drainage for rinse liquid used in such cleansing.

2. A sponge bath and rinse platform formed as an integral one-piece rigid structure for supporting a user, comprising:

first and second longitudinally extending side walls;

a transversely extending head end wall;

a transversely extending foot end wall;

said side and end walls being formed to a height above a grade plane, said grade plane sloping gently from a maximum elevation proximate said head end wall to a minimum elevation proximate said foot end wall;

a head support adjacent said head end wall, for supporting the user's head above said grade plane;

an upper trunk support, located to confront the user's shoulder blade area, for supporting the user's upper trunk above said grade plane;

a lower trunk support, located to confront the user at about waist level for supporting the user's lower back and buttocks above said grade plane;

opposed first and second arm supports, adjacent said first and second side walls and at a longitudinal position generally corresponding to that of said lower trunk support, for supporting the user's arms away from the user's trunk; and opposed first and second leg supports, adjacent said first and second side walls, for supporting the user's legs in a spread-apart position above said grade plane;

wherein the region between said leg supports lies generally in said grade plane to provide drainage to a collection area adjacent said foot end wall, said arm supports are spaced from said lower trunk support to define first and second drainage paths from the region proximate said head support to said region between said leg supports, and said upper and lower trunk supports are formed with a medial groove to define a third drainage path;

whereupon when the user's head is on said head support, the user's arms on said arm supports, the user's shoulder blade area on said upper trunk support the user's lower back and buttocks on said lower trunk support, and the user's legs on said leg supports, the user is in a position with the user's armpit and groin areas elevated above said grade plane and freely accessible for cleansing;

whereupon cleansing of the user can be effected with said first, second, and third drainage paths and said sloping grade plane providing adequate drainage for rinse liquid used in such cleansing.

3. The invention of claim 2 wherein said head support slopes downwardly away from said end wall and is formed with a slight concavity to provide comfort and head support while maintaining drainage away from said head end wall.

4. The invention of claim 2 wherein said side and end walls are formed with an upwardly and outwardly extending peripheral lip at their lower margins to reinforce the walls and contain splashed liquid.

5. The invention of claim 2 wherein said grade plane has a slope in the range of about 2–6%.

6. The invention of claim 2 wherein said head end wall is higher than said foot end wall and wherein the upper margins of said side walls slope gently downwardly from said head end wall to said foot end wall.

7. The invention of claim 2, and further comprising conduit means for carrying water away from said collection area.

8. A sponge bath and rinse platform formed as an integral one-piece rigid structure for supporting a user, formed with a generally sloping bottom including raised portions defining:

head support means for supporting the user's head;

back support means for supporting the user's lower back and buttocks;

arm support means for supporting the user's arms away from the user's trunk; and leg support means for supporting the user's legs in a spread-apart position;

wherein the platform is configured to provide drainage past said arm support means to a collection area;

whereupon when the user's head is on said head support means, the user's arms on said arm support means, the user's lower back and buttocks on said back support means, and the user's legs on said leg support means, the user is in a position with the user's underarm and groin areas maintained above said sloping bottom, and freely accessible for cleansing with said sloping bottom providing adequate drainage for rinse liquid used in such cleansing.

9. The invention of claim 8 wherein said head support means is formed with a slight concavity to provide comfort and head support and slopes to maintain drainage.

10. The invention of claim 8 wherein said platform is formed with sidewalls having upper margins that slope gently downwardly from said head support means.

11. The invention of claim 8, and further comprising conduit means for carrying water away from said collection area.

* * * * *